US006015355A

United States Patent [19]

Angel

[11] Patent Number: 6,015,355

[45] Date of Patent: Jan. 18, 2000

[54] GOLF PUTTER

[76] Inventor: John M. Angel, 9 Hawthorne Place, St. John's, Newfoundland, Canada, A1B 4H3

[21] Appl. No.: 08/667,358

[22] Filed: Jun. 21, 1996

Related U.S. Application Data

[63] Continuation of application No. 08/331,958, Oct. 31, 1994, abandoned.

[51] Int. Cl.[7] ..... A63B 53/02

[52] U.S. Cl. ..... 473/314; 473/313

[58] Field of Search ..... 473/204, 300, 473/246, 248, 313, 293, 287, 289, 560, 241, 314

[56] References Cited

U.S. PATENT DOCUMENTS

| | | | |
|---|---|---|---|
| 4,462,595 | 7/1984 | Hodson | 273/77 R |
| 4,592,552 | 6/1986 | Garber | 273/77 R |
| 4,712,798 | 12/1987 | Preato | 273/81.2 |
| 4,852,877 | 8/1989 | Scalf | 273/81.3 |
| 4,852,878 | 8/1989 | Scalf | 273/77 R |
| 5,029,860 | 7/1991 | Ehrich | 273/81.2 |
| 5,125,130 | 6/1992 | Stanish | 273/81.3 |
| 5,160,141 | 11/1992 | Crews | 273/164 |
| 5,257,807 | 11/1993 | Baumann et al. | 273/80.2 |
| 5,328,185 | 7/1994 | Finnigan et al. | 273/77 R |
| 5,716,287 | 2/1998 | Levocz et al. | 473/248 |

*Primary Examiner*—John G. Weiss
*Attorney, Agent, or Firm*—Donald E. Hewson

[57] ABSTRACT

A golf putter for permitting the accurate putting by a golfer of a golf ball at rest on a putting green is disclosed. The golf putter comprises a golf club head having a striking face shaped, angled and dimensioned to contact the golf ball, so as to putt the golf ball. The golf club head has a defined bottom surface shaped and oriented so as to be co-operatingly aligned with the putting green at the golf ball. An elongate shaft has a first lower end and a second upper end, with the elongate shaft being operatively attached at its first lower end to the golf club head. The elongate shaft extends upwardly from the golf club head at an included angle of 140° or greater with respect to the defined bottom surface. An upper hand grip portion shaped and dimensioned for gripping by a chosen single hand of the golfer is secured to the elongate shaft adjacent the second upper end. A lower hand grip portion shaped and dimensioned for gripping by the other hand of the golfer is secured to the elongate shaft between the second upper end and the first lower end. When the golf putter is properly gripped by the golfer, the golfer's two hands are positioned in spaced-apart relation, one hand on each of the upper and lower hand grip portions.

16 Claims, 4 Drawing Sheets

GOLF PUTTER

This application is a continuation of Ser. No. 08/331958 filed Oct. 31, 1994, now abandoned

FIELD OF THE INVENTION

This invention relates to golf clubs and more particularly to golf putters. Specifically, this invention relates to golf putters that provide for extremely accurate control of the putting stroke in terms of direction and speed.

BACKGROUND OF THE INVENTION

In the game of golf, the accuracy of a golf shot is determined by the speed, the direction of travel, and the spin of the golf ball. Of course, there are other factors, such as weather conditions that also affect the accuracy of a golf shot, but factors such as these are beyond the control of a golfer. The speed, direction of travel, and spin of the golf ball are determined mainly by the speed and the direction of the swing of the golf club head, and by the orientation of the face of the golf club head, as the golf club head impacts the ball. These three factors are quite controllable by a golfer; however, the very nature of bodily interaction by a person with an inanimate object, where the object is being physically controlled by that person, dictates that there will be imprecision in the manipulation of that object. In golf, this fact is illustrated by the difficulty that even professional golfers experience in hitting a golf ball precisely to a desired location.

When using woods and irons, the speed and direction of the club head is important; but, especially when driving the ball, significant variation in the speed and direction of the ball is virtually unavoidable, and is therefore expected. Indeed, drives made by an individual golfer may vary in distance by several tens of yards and may vary from left to right by many yards, with all such shots being considered relatively good. Even approach shots, which are not quite as long as drives, may vary by several yards in distance, and from left to right.

In putting, control of the speed and direction of the ball is particulary important. The ball must be putted accurately, as there is very little room for error. Indeed, the ball must end up in one location only, with that location being a hole that is only about two to three times the diameter of the golf ball. The final shot that sinks the ball into the hole must be extremely accurate, both in terms of speed and direction of the shot when it leaves the face of the golf putter. Variation in the speed and direction of putts by only a small amount may significantly increase the chance of adding to the number of strokes taken to sink a golf ball. Missing a putt by an inch or two can result in an increase in score by one or more strokes on a hole. Multiplied over eighteen holes, such additional strokes can cause an extremely significant inflation of a golfer's score, from a very respectable score, even a sub-par score, to a score of perhaps over one hundred. This situation is possibly best expressed in the old adage "drive for show . . . putt for dough".

Putting involves relatively short distances, as opposed to the longer distances of drives and approach shots, and the variance of perhaps a foot—or even a few inches—in the distance or accuracy of a putt may be extremely significant. Indeed, the mechanics of a putting stroke are significantly different than any other golf stroke, due to the importance of the accuracy that is required for a good putt as opposed to the need for long distance. Most putters have a hand grip disposed at the top end of the shaft thereof. This grip is gripped by both hands of the golfer, with both hands each being wrapped around the grip and placed in a contiguous manner one to the other along the grip, with the thumb of the upper hand interposed into the palm and finger area of the other hand in order to provide lateral stability of the two hands with respect to each other. In this manner, the two hands work together to provide a stable grip on the putter. This type of grip is generally accepted as being the proper and, indeed, the best grip to use while putting.

This particular style of gripping a putter works well, to a degree, because both hands are used synergistically to form a co-operating stable grip that generally precludes each separate hand from readily moving with respect to the other. Each hand therefore cannot readily impart stray acceleration and twisting forces to the putter during a swing of the putter.

However, there is one problem that is inevitably associated with this type of golf club grip. Due to the fact that the golfer's hands are so close to one another on the grip, a small amount of improper movement or twisting of either of the golfer's hands with respect to the other can cause a severe change in the angle or speed of the putter shaft and a severe change in the orientation of the face of the putter. In putting, such minor changes can cause a shot to be propelled to a substantially different location than the aimed for and intended location, thus causing the shot to be essentially missed.

Further, there is another problem associated with the use of the above described manner of gripping a golf putter. It is necessary when gripping a putter in this manner, to adopt a stance wherein the golfer's feet are relatively close to the ball. Such a stance necessitates that the golfer's arms are held with the elbows pointing outwardly in opposed directions, which is unnatural, and further that the swing be made from the shoulders with no body movement, which again is unnatural, difficult, and prone to error. Further, while using this stance, the golfer's eyes are generally directly vertically over the golf ball, so as to line up the golfer's eyes, the ball, and the hole in a single vertically disposed plane. It can be argued that this is undesirable as the visual clues as to the distance of the hole from the golf ball, and also as to the direction the golf ball must be directed, should be three-dimensional clues. The science of perceptual psychology teaches that several visual clues are used to form a three-dimensional picture of the relative spacing, speed, and so on, of two objects in order to determine the actual spatial relationship of these two objects. It is much more difficult to form this three dimensional picture when a person is directly aligned with two objects. It is more easily done when a person is offset from direct alignment with these objects, as more clues as to the three-dimensional spatial relationship of these two objects are available. Such spatial perception of two objects is often referred to as "triangulation".

In other sports, such as hockey, "triangulation" is used to allow a pass to made quite accurately, both in terms of speed and direction, with relative ease, even if done quickly. It is generally quite easy for a hockey player, even a young hockey player, to make quite accurate passes.

Another problem associated with the use of the above described manner of gripping a golf putter is that it is very difficult, if not impossible, to directly view both the golf ball and the hole in the green at the same time. Thus, a golfer's visual perception of where the hole is and the topography of the area around the hole must be cognatively matched to that golfer's visual perception of where the golf ball is on the topography of the area around the golf ball. Since an "entire picture" including the golf ball and the hole in the green cannot be seen at once, it is difficult to properly aim a putt.

It is only by the elimination of the three of these above discussed problems that accurate and consistent putting can be achieved. In an effort to improve the putting accuracy and consistency of golfers, whose skill levels might range from novice to professional, many variations of putters have been created; however, all of these prior putters are designed for use in such a way that encourages these problems, so as to cause inherent inaccuracies in putting.

It is an object of the present invention to provide a golf putter that readily permits making accurate and consistent putts, in terms of speed and distance.

It is a further object of the present invention to provide a golf putter that permits the use of a golfer's hands in a separated manner.

It is another object of the present invention to provide a golf putter that permits a golfer to view the golf ball and the hole in the green concurrently.

It is a further object of the present invention to provide a golf putter that permits visualization and aiming of a putt by way of triangulation of the golf ball and hole in the green.

DESCRIPTION OF THE PRIOR ART

U.S. Pat. No. 5,160,141 to CREWS discloses a golf putter having a shaft that can be positioned at an angle of 10° through 60° with respect to a vertical axis, which corresponds to an angle with respect to the bottom surface of the putter head being in the range of from 100° through 150°. An angle of 150° between the putter shaft and the bottom surface of the head of the putter is, indeed, enough to cause the putter head to be disposed perhaps a couple of feet, or more, away from the feet of the golfer. The only type of golf club grip that is disclosed, is a conventional golf club grip that is to be used in a conventional manner, as discussed above.

U.S. Pat. No. 4,852,877 to SCALF discloses a push-type golf putter wherein the golfer is positioned directly behind the golf ball so as to have a straight line of sight with respect to the golf ball and the hole in the green. The shaft is oriented at an unusual angle in order to permit the golfer to be in such alignment with the ball and the hole.

No known prior art teaches a golf putter that permits a golfer to stand significantly off the vertical plane defined by the hole in the green and the golf ball by an amount sufficient to allow for triangulation, and that also permits for an alternative gripping arrangement that ameliorates the possibility of errors to the relative motion of a golfer's hands with respect to each other.

SUMMARY OF THE INVENTION

In accordance with one aspect of the present invention, there is provided a golf putter for permitting the accurate putting by a golfer of a golf ball at rest on a putting green. The golf putter comprises a golf club head having a striking face shaped, angled and dimensioned to contact the golf ball, with the golf club head having a defined bottom surface shaped and oriented so as to be co-operatingly aligned with the putting green at the golf ball. An elongate shaft has a first lower end and a second upper end, and is operatively attached at the first lower end thereof to the golf club head so as to extend upwardly from the golf club head at an included angle of 140° or greater with respect to the defined bottom surface. An upper hand grip portion is secured to the elongate shaft adjacent the second upper end, the upper hand grip portion being shaped and dimensioned for gripping by a chosen single hand of the golfer. A lower hand grip portion is secured to the elongate shaft between the second upper end and the first lower end, the lower hand grip portion being shaped and dimensioned for gripping by the other hand of the golfer. The golf putter is properly gripped by the golfer using the hands positioned in spaced-apart relation, one hand on the upper hand grip portion and the other hand on the lower hand grip portions.

BRIEF DESCRIPTION OF THE DRAWINGS

Embodiments of this invention will now be described by way of example in association with the accompanying drawings in which.

DETAILED DESCRIPTION OF THE PREFERRED EMBODIMENTS

Figure 1:
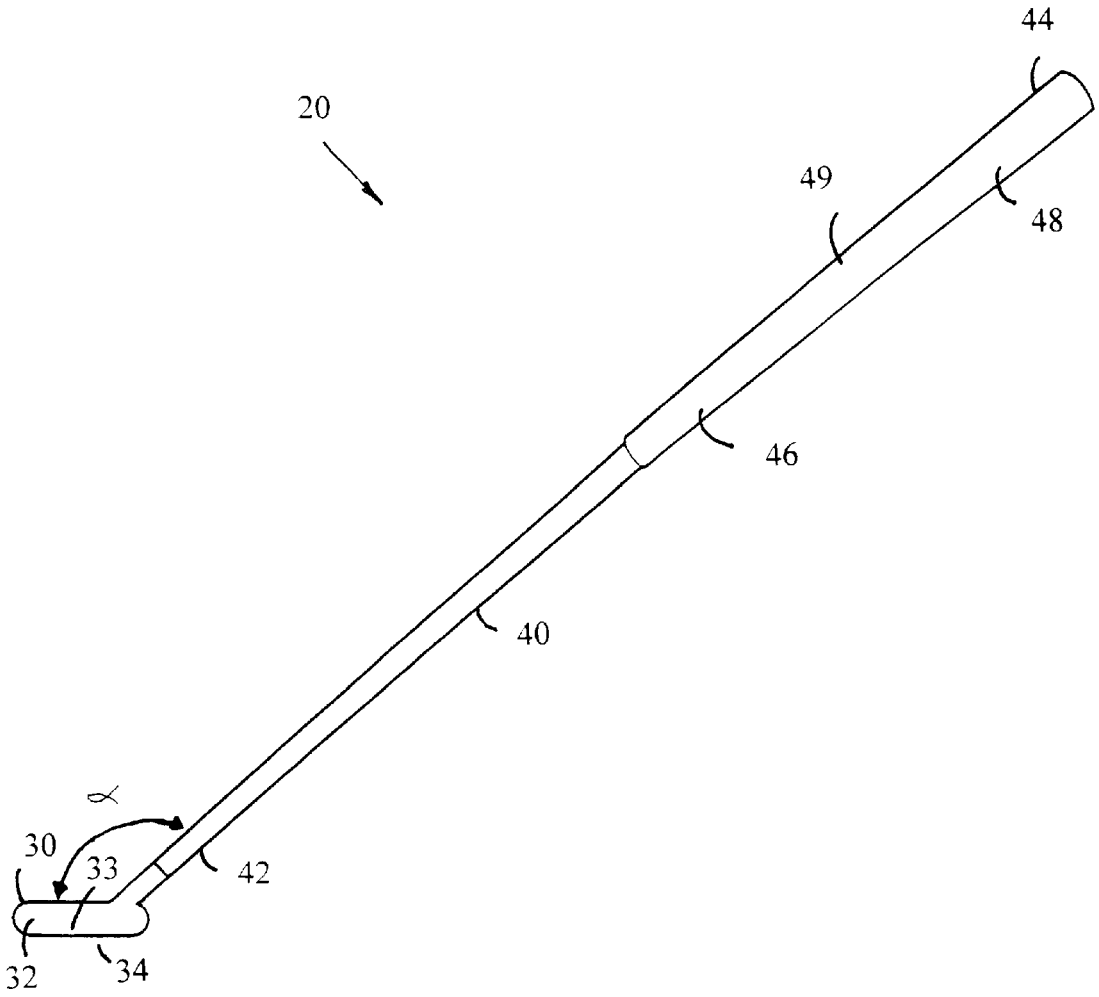
FIG. 1 is a side elevational view of the preferred embodiment of the golf putter of the present invention in an "in-use" position, with a golfer's hands not shown.
Figure 2:
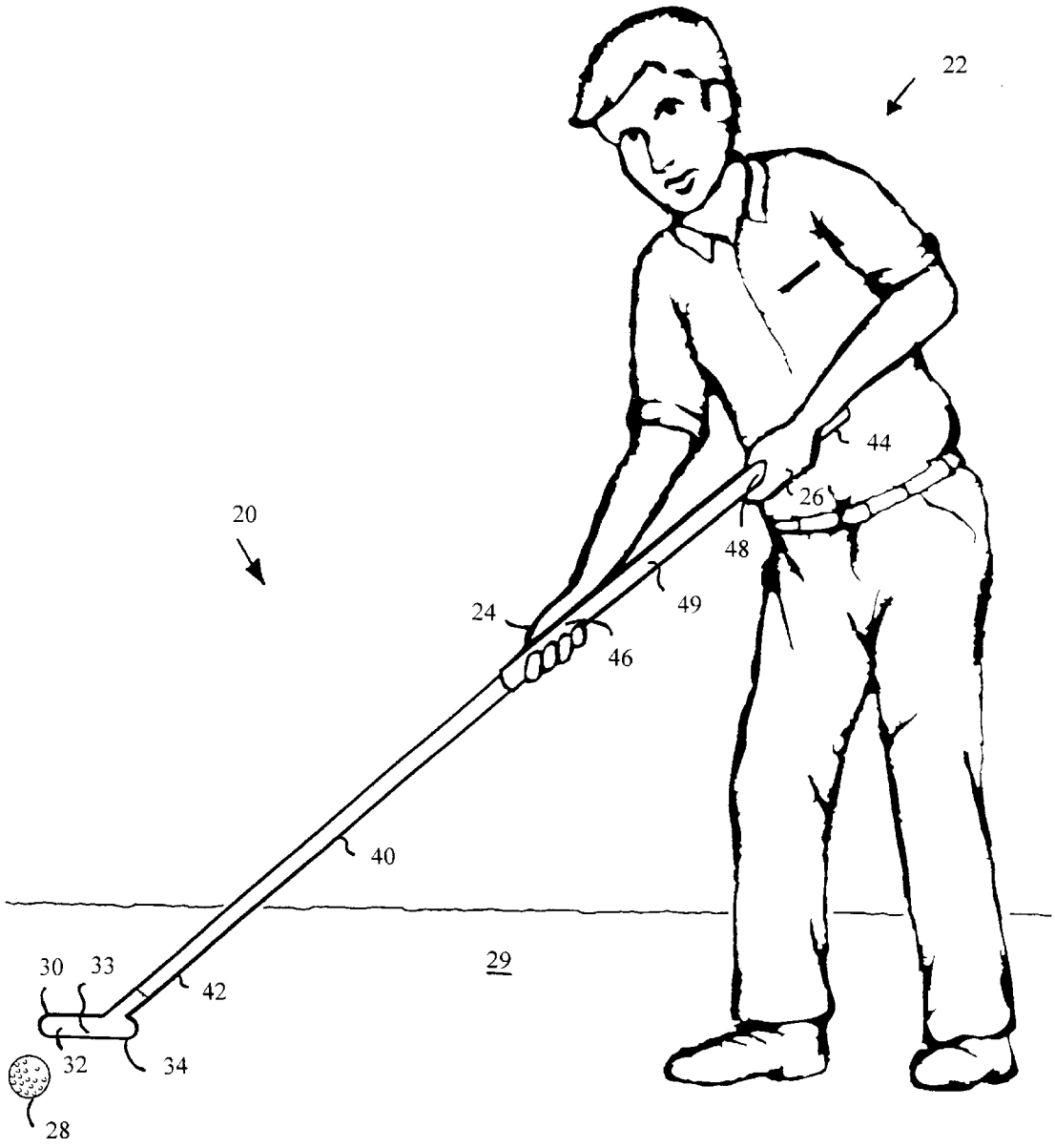
FIG. 2 is a side elevational view similar to FIG. 1, with the putter "in-use", and also showing a golfer's hands and the golf ball.
Figure 3:
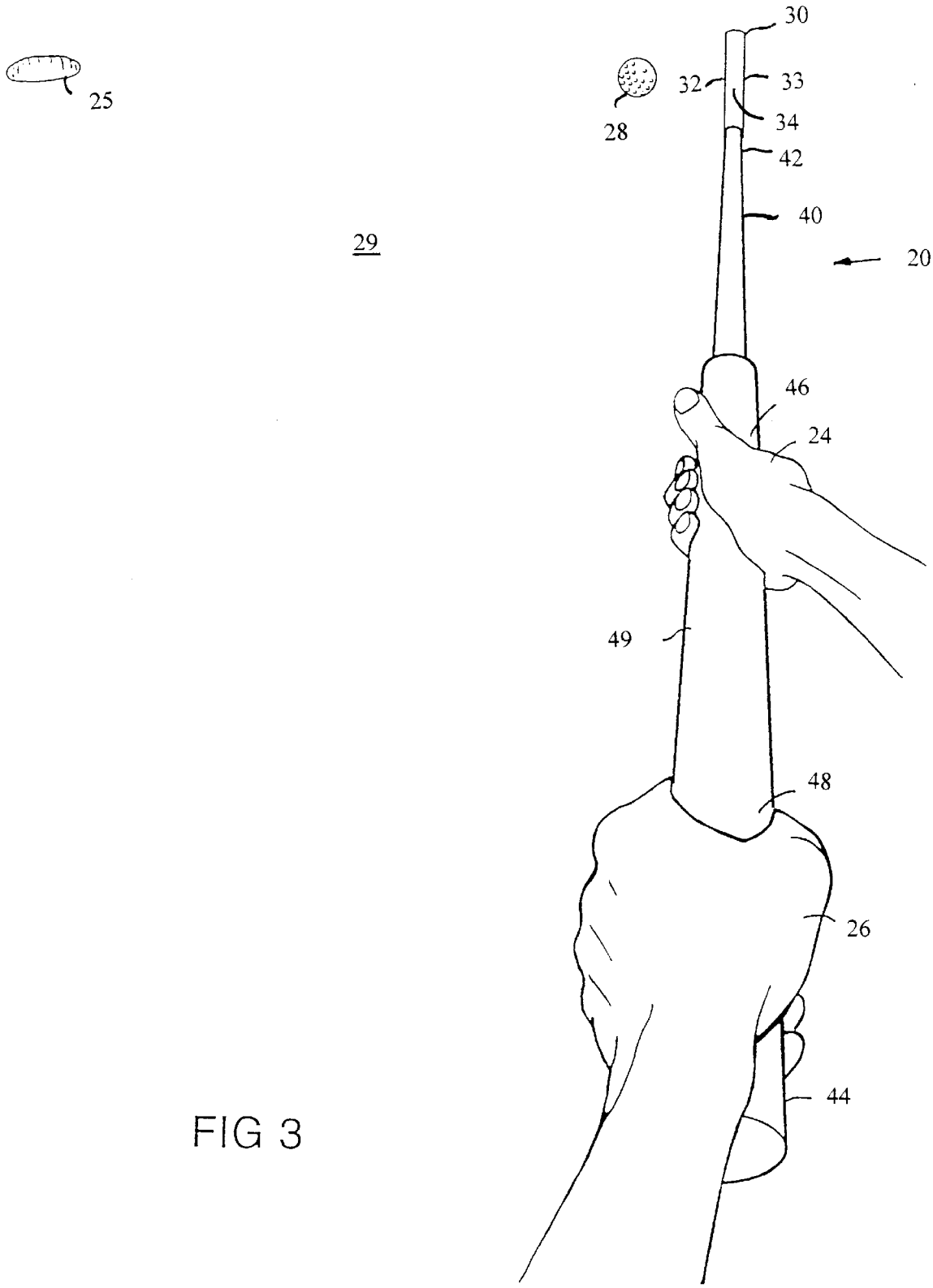
FIG. 3 is a perspective view of the green, golf ball, and golf club of the present invention with the putter in use, all seen from the eyes of a golfer using the golf club.

Reference will now be made to FIGS. 1 through 3, which show the preferred embodiment of the golf putter of the present invention. The golf putter, which is indicated by the general reference numeral 20, permits the accurate putting by a golfer 22 (shown in FIG. 2) of a golf ball 28 at rest on a putting green 29. The golf putter 20 comprises a golf club head 30 having a striking face 32 on one side thereof and a striking face 33 on the opposite other side thereof. The striking face 32 is for use by right-handed golfers and the striking face 33 is for use by left-handed golfers. In the preferred embodiment, the striking face 32 and the striking face 33 are each substantially planar so as to face toward the hole 25 in the putting green 29. It is also possible to have golf putter 20 of the present invention having only one of the striking faces 32 or 33, for use with a right-handed golfer or a left-handed golfer only, as the case may be.

The golf club 30 also has a defined bottom surface 34 shaped and oriented so as to be co-operatingly aligned with the putting green 29 at the golf ball 28. In the preferred embodiment, the aligned bottom surface 34 is generally flat so as to generally align with the surface of the putting green 29, which is in effect a generally flat surface. It is possible to make the defined bottom surface 34 of the golf club head 30 any shape that will permit a golfer to properly align the golf club head 30 with the putting green 29, either contacting with the putting green 29 or just over the putting green 29.

An elongate substantially straight shaft 40, which shaft 40 is preferably more than 110 cm in length and, in the preferred embodiment is about 130 cm in length, has a first lower end 42 and a second upper end 44. The elongate shaft 40 is operatively attached at its first lower end 42 thereof to the golf club head 30. This attachment may be permanent so that the golf club head 30 is not removable from the elongate shaft 40, or the elongate shaft 40 can be removably attached to the golf club head 30 so as to allow for the interchange of different designs of golf club heads. The removable elongate shaft 40 preferably would threadibly engage a co-operating threaded aperture in the golf club head 30.

The elongate shaft 40 extends upwardly from the golf club head 30 at an included angle "α" of about 140° in the preferred embodiment. This angle may be greater than 140°, and even as much as about 160°, depending on the "lie" that is desired of the elongate shaft 40. The included angle is measured between the elongate shaft 40 and the defined bottom surface 34 of the golf club head 30.

Figure 4:
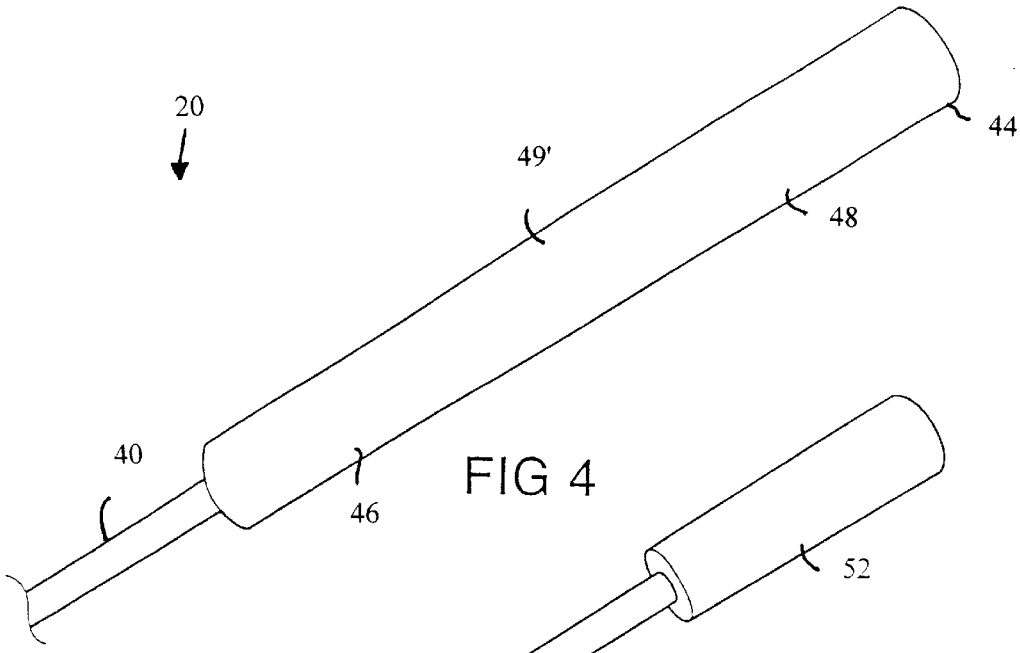
FIG. 4 is a side elevational view of the upper end of the golf putter of the present invention with a larger diameter hand grip thereon.

A lower hand grip portion 46 is secured to the elongate shaft 40 between the second upper end 44 and the first lower end 42. In the preferred embodiment, the lower hand grip portion 46 is disposed about one-third the way down the elongate shaft 40. An upper hand grip portion 48 is securely attached to the elongate shaft 40 adjacent the second upper end 44. The upper hand grip portion 48 is shaped and dimensioned for gripping by a chosen single hand 24 of the golfer 22, and the lower hand grip portion 46 is shaped and dimensioned for gripping by the other hand 26 of the golfer 22. In the preferred embodiment, the upper hand grip portion 48 and the lower hand grip portion 46 together form a single continuous hand grip 49 that is about 70 cm in length, and in any event should be at least 60 cm in length. Also, in the preferred embodiment, the lower hand grip portion 46 and the upper hand grip portion 48 are each separately removable from the elongate shaft 40 and replaceable thereon so as to be interchangeable. FIG. 4 shows the golf putter 20 having a single continuous hand grip 49' that is of a greater diameter than that of the hand grip 49 shown in FIGS. 1 through 3. The hand grips 49 and 49' are removable and replaceable so that a preferred hand grip may be selected and placed on the golf putter 20 by the golfer 22.

As can be best seen in FIGS. 2 and 3, when the golf putter 20 is in use and is properly gripped by the golfer 22 using his two hands 24 and 26 positioned in spaced-apart relation, with one hand on the upper hand grip portion 48 and the other hand on the lower hand grip portion 46, in contrast to a conventional style of gripping a putter wherein a golfer's hands 24 and 26 are juxtaposed one to the other. The golf putter 20 of the present invention permits the golfer 22 to use "triangulation" to align a putt. Triangulation permits the golfer to see both the golf ball 28 and the hole 25 in the putting green 29, thus permitting accurate putting by the golfer 22.

Figure 5:
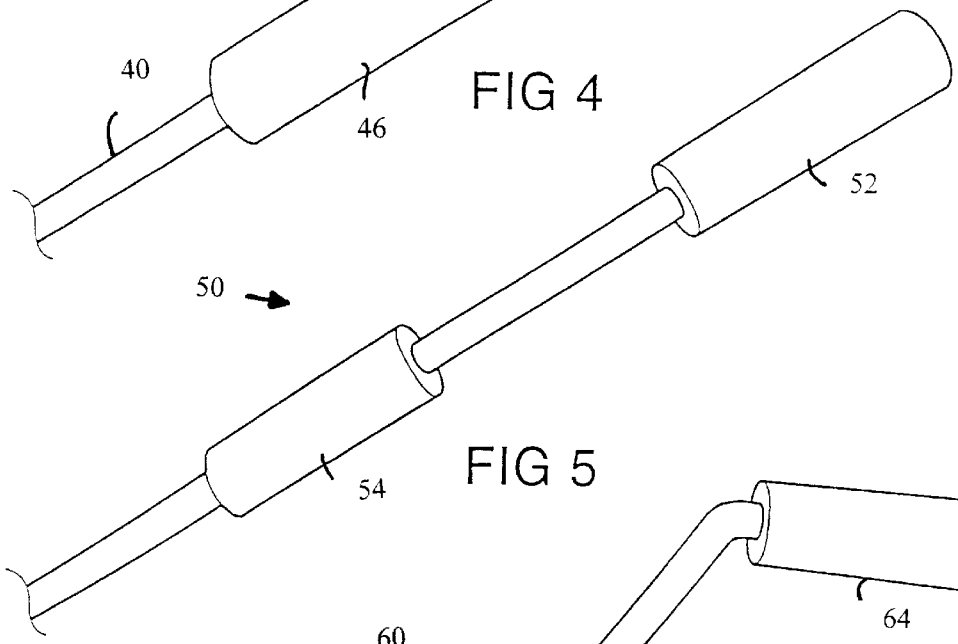
FIG. 5 is a side elevational view of a first alternative embodiment of the golf putter of the present invention in an "in-use" position, with a golfer's hands not shown.

In one alternative embodiment, as shown in FIG. 5, the golf putter 50 has an upper hand grip portion 52 and a lower hand grip portion 54 that are separate and distinct one from the other. Each of the upper and lower hand grip portions 52 and 54 are about 20 cm to 25 cm in length and are separated by a distance of at least 20 cm, and are preferably separated by a distance of about 30 cm.

Figure 6:
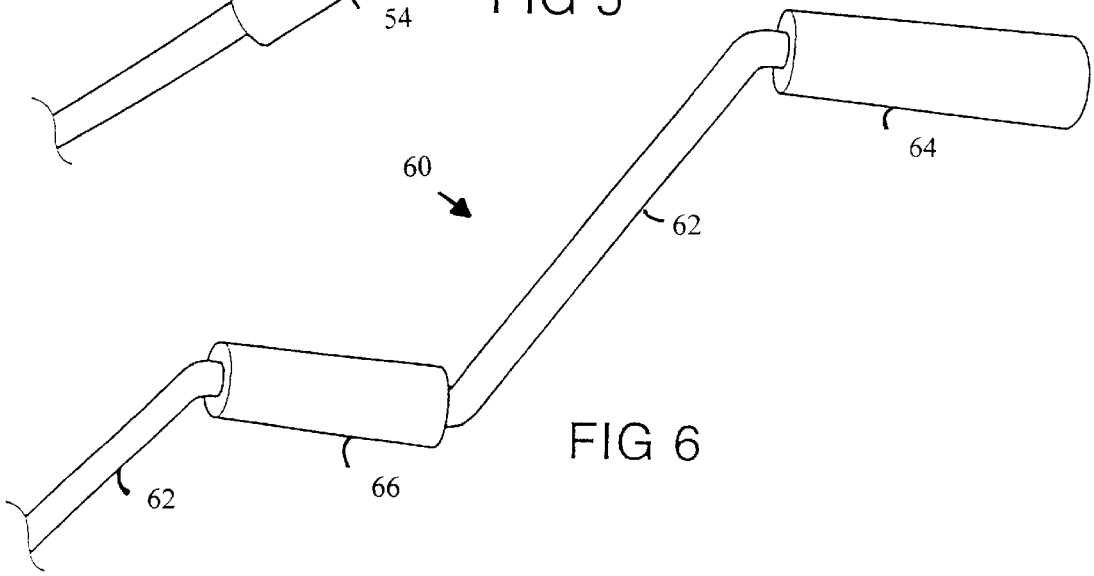
FIG. 6 is a side elevational view of a second alternative embodiment of the golf putter of the present invention in an "in-use" position, with a golfer's hands not shown.

In a further alternative embodiment, as shown in FIG. 6, the golf putter 60 has an elongate shaft 62 with an upper hand grip portion 64 and a lower hand grip portion 66 that are non-colinear with the elongate shaft 62. Such a non-colinear upper and lower hand grip portions 64 and 66 permits for the gripping of the putter with the angle of orientation of a golfer's hand aligned in a generally relaxed position, so as to be, ergonomically speaking, more correct.

Other modifications and alterations may be used in the design and manufacture of the apparatus of the present invention without departing from the spirit and scope of the accompanying claims.

What is claimed is:

1. A golf putter for accurately putting a golf ball toward a cup in a putting surface, where each putt with said golf putter is aligned by means of triangulation of the golf ball, said putting surface cup, and the eyes of a golfer, where the eyes of the golfer are laterally offset from the portion of the putting surface between the golf ball and the putting surface cup, and where the golf ball is to be propelled in a desired direction of initial travel when struck by said golf putter, said golf putter comprising:

an elongate shaft having lower and upper ends and a longitudinal axis oriented along its length;

striking means secured to said shaft means, said striking means being positionable with respect to said golf ball by manipulation of said shaft means, for subsequent striking of said golf ball;

means for properly gripping said elongate shaft such that the hands of said golfer are spaced apart by a distance of at least 30 cm one from the other on said elongate shaft when said golf putter is in use, to thereby permit said manipulation of said elongate shaft; and means for positioning said golfer such that said golfer's eyes are spaced laterally away from said portion of the putting surface between the putting surface cup and the golf ball, thereby permitting said golfer to see the portion of said putting surface between the putting surface cup and the golf ball, thereby permitting said golfer to use triangulation of said golf ball, said cup in the putting surface, and the eyes of said golfer to obtain three-dimensional visual clues of the topography of the portion of the putting surface between said golf ball and said putting surface cup, thus allowing said golfer to accurately determine the desired direction of initial travel of said golf ball, so that said golf ball may be accurately putted toward said putting surface cup;

wherein said striking means comprises a substantially planar striking face of a golf putter head secured to said shaft in a manner so as to be parallel to a plane in which said longitudinal axis of said elongate shaft is disposed;

wherein said golf putter head has a bottom surface which defines a bottom plane which is perpendicular to both of said planes in which said longitudinal axis of said elongate shaft is disposed and said substantially planar striking face; and wherein said means for positioning said golfer comprises there being an included angle of about 140° to 160° between said bottom plane of said golf putter head and said longitudinal axis of said elongate shaft and wherein said striking face is in a plane which is substantially perpendicular to said bottom plane.

2. The golf putter of claim 1, wherein said means for properly gripping said elongate shaft comprises a defined upper gripping region disposed on said elongate shaft adjacent said upper end thereof, and a defined lower gripping region disposed on said elongate shaft in a position between said upper gripping region and said putter head.

3. The golf putter of claim 2, wherein said elongate shaft is more than 110 cm in length.

4. The golf putter of claim 2, wherein said included angle is greater than 150°.

5. The golf putter of claim 2, wherein said elongate shaft is substantially straight.

6. The golf putter of claim 2, wherein said upper hand grip portion and said lower hand grip portion are separate and distinct one from the other.

7. A golf putter for accurately putting a golf ball toward a cup in a putting surface, where each putt with said golf putter is aligned by means of triangulation of the golf ball, said putting surface cup, and the eyes of a golfer, where the eyes of the golfer are laterally offset from the portion of the putting surface between the golf ball and the putting surface cup, and where the golf ball is to be propelled in a desired direction of initial travel when struck by said golf putter, said golf putter, comprising:

an elongate shaft having lower and upper ends and a longitudinal axis oriented along its length;

a putter head secured to said elongate shaft at said lower end thereof, said putter head having a bottom surface disposed in a bottom plane which is perpendicular to a plane in which said longitudinal axis of said elongate shaft is disposed, said bottom surface also being disposed at an included angle of about 140° to 160° with respect to said longitudinal axis of said elongate shaft;

said putter head having a striking face oriented in a plane substantially parallel to said plane in which said longitudinal axis is disposed, and perpendicular to said bottom plane, said striking face being positionable by manipulation of said elongate shaft so as to be generally perpendicular to the desired direction of initial travel of said golf ball;

a defined upper gripping region disposed on said elongate shaft adjacent said upper end thereof, and extending along said shaft a distance sufficient to be gripped by a hand of a golfer when said golf putter is in use; and a defined lower gripping region disposed on said elongate shaft in a position between said upper gripping region and said putter head, and extending along said shaft a distance sufficient to be gripped by the other hand of said golfer;

wherein said defined lower gripping region is displaced from said upper gripping region by a distance of at least 30 cm so that, when in use, said putter is griped by said golfer with one hand on said upper gripping region and the other hand on said lower gripping region;

whereby, when said golf putter is in use, said golfer is caused to stand in such a position that said golfer's eyes are located above said putting surface and are spaced laterally away from said portion of the putting surface between the putting surface cup and the golf ball, thereby permitting said golfer to see, from a laterally offset angle, the portion of said putting surface between the putting surface cup and the golf ball, and thereby permitting said golfer to use triangulation of said golf ball, said cup in the putting surface, and the eyes of said golfer to accurately determine the desired direction of initial travel of said golf ball, so that said striking face may be positioned by means of manipulation of said elongate shaft so as to be generally perpendicular to the desired direction of initial travel of said golf ball.

8. The golf putter of claim 7, wherein said elongate shaft is more than 110 cm in length.

9. The golf putter of claim 8, wherein said included angle is greater than 150°.

10. The golf putter of claim 9, wherein said elongate shaft is substantially straight.

11. The golf putter of claim 10, wherein said lower hand grip portion is removable from said elongate shaft and replaceable thereon.

12. The golf putter of claim 10, wherein said upper hand grip portion is removable from said elongate shaft and replaceable thereon.

13. The golf putter of claim 10, wherein said golf club head striking face is substantially planar.

14. The golf putter of claim 7, wherein said lower hand grip portion is non-colinear with said elongate shaft.

15. The golf putter of claim 10, wherein said golf club head is removable and replaceable.

16. The golf putter of claim 15, wherein said upper gripping region and said lower gripping region are separate and distinct one from the other.

* * * * *